United States Patent [19]

Kaito

[11] 4,040,369

[45] Aug. 9, 1977

[54] CONVERTIBLE-BED TYPE SEWING MACHINE HEAD

[75] Inventor: Yukio Kaito, Yamagata, Japan

[73] Assignee: Happy Sewing Machine Manufacturing Company, Yamagata, Japan

[21] Appl. No.: 726,817

[22] Filed: Sept. 27, 1976

[30] Foreign Application Priority Data

Nov. 17, 1975 Japan ..... 50-137252

[51] Int. Cl.[2] ..... D05B 75/00

[52] U.S. Cl. ..... 112/258

[58] Field of Search ..... 112/258, 217.1, 260

[56] References Cited

U.S. PATENT DOCUMENTS

| | | | |
|---|---|---|---|
| 3,570,431 | 3/1971 | Fresard | 112/258 |
| 3,646,900 | 3/1972 | Fresard | 112/258 |
| 3,677,210 | 7/1972 | Perlino | 112/258 |
| 3,683,833 | 8/1972 | Baruffa | 112/258 |
| 3,685,473 | 8/1972 | Fresard | 112/258 |

FOREIGN PATENT DOCUMENTS

| | | | |
|---|---|---|---|
| 665,574 | 1/1952 | United Kingdom | 112/260 |

*Primary Examiner*—George H. Krizmanich
*Attorney, Agent, or Firm*—Michael, Best & Friedrich

[57] ABSTRACT

A sewing machine head having a tubular or free-arm type bed extending from the upstanding column and overhanging the base plate of the machine head and also having a front and a rear auxiliary bed each pivotally secured to the base plate along the front or rear edge thereof. When swung up, the auxiliary beds form a flat work-supporting table of extended area in cooperation with the tubular bed. With such bed structure, convertion between the free-arm type and flat-table type bed settings can be effected with extreme ease and efficiency. The auxiliary beds can also be utilized as a case for storing bobbins, needles, screw drivers, etc., eliminating the need for any separate storing cases.

1 Claim, 3 Drawing Figures

CONVERTIBLE-BED TYPE SEWING MACHINE HEAD

BACKGROUND OF THE INVENTION

The present invention relates generally to sewing machine heads and more particularly to those of the convertible-bed type or the type having a bed structure adapted to form a so-called flat-table type bed or a so-called free-arm type bed as desired in use for the form of fabric to be worked.

As is well known, sewing machine beds are generally classified into two types, flat-table and free-arm. Flat-table type beds have a work table portion with a needle plate mounted thereon and which extends under the entire overhead arm of the machine head to define a wide, flat work-supporting surface. In contrast, free-arm type beds are tubular in form, extending horizontally from one side of the vertical column of the machine head substantially in parallel with the overhead arm thereof for convenience in sewing sleeves or other work fabrics of tubular form. In the past, sewing machines have usually been formed with a bed of one or the other of the two different types. It is highly desirable, however, to provide on a single sewing machine a bed structure capable of serving as a flat-table type bed and also as a free-arm type one and various forms of sewing machines have previously been proposed which have a bed structure convertible or usable in two ways, as a flat-table type and a free-arm type bed.

Conventional forms of convertible-bed type sewing machine have actually been of the so-called free-arm type, including a tubular or free-arm type bed extending horizontally from one side of the vertical column of the machine head and a bed attachment or an auxiliary bed member which is udapted to be detachably fitted to the tubular bed with a slot formed to fittingly receive the latter and has a top surface formed to serve as a continuation of the elongate work-supporting top surface of the tubular or free-arm bed. Such sewing machines are usable as a flat-table type machine with the auxiliary table member fitted around the free-arm bed and, for sewing tubular fabrics, are used as a free-arm bed type machine with the auxiliary table member removed from the machine head. In sewing various forms of work fabric with such conventional machines, it has been necessary to attach and detach the auxiliary table member from time to time involving substantial loss of labor and time.

SUMMARY OF THE INVENTION

The present invention has for its object the provision of a convertible-bed type sewing machine which is readily convertible from one bed setting to the other and vice versa.

Another object of the present invention is to provide a convertible-bed type sewing machine which does not include any member to be detached therefrom to obtain a free-arm type bed on the machine and is free from the trouble of removing such member from the machine and laying it aside in order.

A specific object of the present invention is to provide a sewing machine head which has a free-arm type bed and a front and a rear auxiliary bed pivotally secured to the base plate of the machine head along the front and rear edges thereof for up and down swinging movement and which can be used as a free-arm or tubular bed type sewing machine with the two auxiliary beds swung down and can form a flat-table type sewing machine simply by swinging the front and rear auxiliary beds into upright position.

A further object of the present invention is to provide a convertible-bed type sewing machine of the character described which is conveniently usable with its auxiliary beds each made hollow to serve as a case for storing various articles such as spare bobbins, needle cases and sewing rules, thus eliminating the need for any separate storing cases for such articles.

The above and other objects, features and advantages of the present invention will become apparent from the following description when taken in conjunction with the accompanying drawing.

DESCRIPTION OF THE PREFERRED EMBODIMENT

Figure 1:
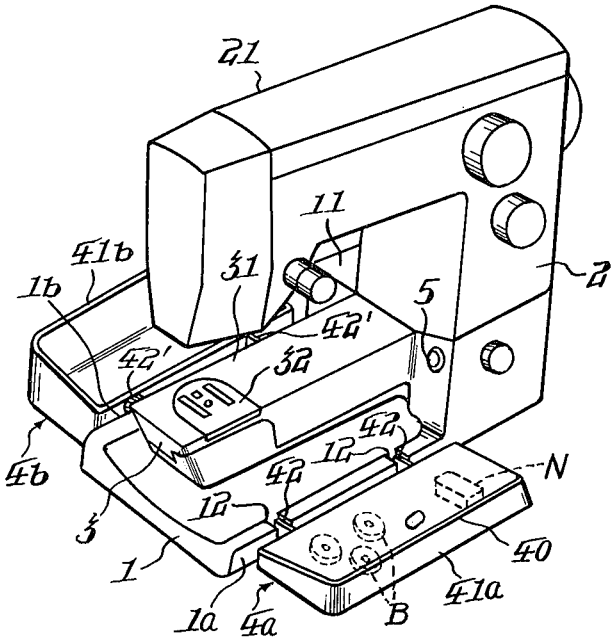
FIG. 1 is a perspective view showing one preferred embodiment of the present invention in its state usable as a free-arm type sewing machine.
Figure 2:
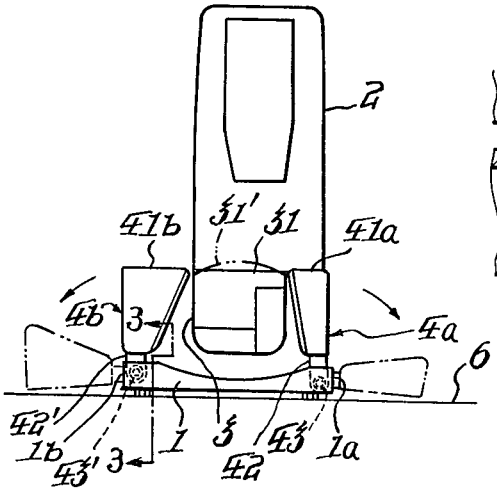
FIG. 2 is a side elevational view of same, looking from the left-hand side of FIG. 1.

Referring to the drawing and particularly to FIGS. 1 and 2, the sewing machine head illustrated includes a base plate 1, a an upstanding column 2 generally vertically extending from one end portion of the base plate in the conventional manner, and an overhead arm 21 formed integral with the vertical column 2 and overhanging the base plate 1. An elongate tubular bed 3 extends horizontally from a lower portion of the vertical column 2, overhanging the base plate 1 substantially along the median thereof. The tubular bed 3 has a substantially horizontally extending flat top surface 31 and has mounted thereon a well-known form of needle plate 32. According to the usual practice, a shuttle mechanism and also a feed mechanism (both not shown) are arranged in the elongate tubular bed 3.

According to the present invention, auxiliary beds are arranged in front of and behind the tubular bed 3 for up and down swinging movement, as generally indicated by reference numerals **4*a* and 4*b*, respectively. The two auxiliary beds each have a body in the form of a generally rectangular hollow box opening on one side or at the top, as shown with the rear auxiliary bed 4*b* in FIG. 1, and formed with a pair of supporting legs 42 — 42 on one side thereof, as clearly seen on the front auxiliary bed 4*a* in FIG. 1**.

Figure 3:
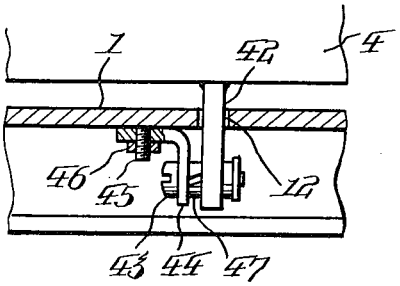
FIG. 3 is an enlarged frag-mentary cross-sectional elevation taken along the line 3—3 in FIG. 2, illustrating the manner in which the auxiliary beds are pivotally secured to the base plate of the machine head.

Reference numeral 12 indicates a pair of slits formed in the front edge **1*a* of the base plate 1 and, as shown in FIG. 3 on an enlarged scale, an L-shaped bracket 44 is fixed to the underside of the base plate 1 adjacent to each of the slits 12 by means of a threaded stud 45, secured to the base plate 1, and a nut 46. The auxiliary beds are each pivotally mounted on the base plate 1 in a manner such that its open top faces the tubular bed 3 when it is swung up. Namely, the front auxiliary bed 4*a*, located on the front side of tubular bed 3, has its legs 42 inserted into the base plate 1 through the respective slits 12 in the adjacent edge of the base plate 1 and each pivotally secured to the adjacent bracket 44 by means of a pivot screw 43 fitted thereto, with a spring washer 47** interposed between the leg 42 and the adjacent side surface of the bracket 44. In this manner, the front auxiliary bed 4*a* is pivotably mounted on the front edge portion of the base plate 1 substantially in parallel with the tubular bed 3 so that the open side of the auxiliary bed 4*a* faces the tubular bed 3 when the bed 4*a* is swung up. The base plate 1 is also formed in its rear edge portion with a pair of slits similar to those, 12, formed in the front edge portion of the base plate and the rear auxiliary bed 4*b* has its legs 42' inserted through such slits into the base plate and pivotally secured thereto by means of respective pivot screws 43' in the same manner as the legs 42 of front auxiliary bed 4*a.* The rear auxiliary bed 4*b* is thus pivotally mounted on the base plate along the rear edge thereof substantially in parallel with the tubular bed 3 and, when swung up, its open side faces the latter. Spring washers 47, each compressed between the supporting bracket 44 and leg 42, provide an appropriate frictional resistance to the swing or pivotal movement of the auxiliary beds about the respective pairs of aligned pivot screws 43 — 43 and 43' — 43' so that the auxiliary beds, when swung down as indicated by the chain-dotted lines in FIG. 2, can be held in their downswung position stably without any play.

It is to be noted that the box-like auxiliary bed 4*a* and 4*b,* when swung up as indicated by the solid lines in FIG. 2, are brought into contact with the front and rear sides of tubular bed 3 and, in this state, their top surfaces 41*a* and 41*b* serve as an auxiliary work-supporting surface lying substantially in the same plane as the flat top surface 31 of the tubular bed 3.

Referring to FIG. 1, reference numeral 40 indicates a cover plate detachably fitted or pivotally secured to the open side of the box-like body of front auxiliary bed 4*a.* Though not shown, partitions and clips or hooks are suitably arranged in the interior of the auxiliary bed 4*a* to enable it to serve as a case for storing spare bobbins B, needle cases N, seamline rules and other accessories and tools such as a screw driver. The rear auxiliary bed 4*b* as illustrated in FIG. 1 is not provided with any cover plate but it is to be understood tht the rear auxiliary bed 4*b* may also be providedwith a cover plate for storing accessories and other articles therein. With such arrangement of auxiliary beds 4*a* and 4*b,* it will readily be appreciated that there is no need for any storing cases as provided separately with previous forms of sewing machine head.

In FIG. 1, reference numeral 5 indicates a spring-biased steel ball provided on that side of the vertical column 2 from which the tubular bed 3 extends and in front of the junction of the tubular bed 3 with the column 2. The steel ball 5, partly projecting from the column side, cooperates with a corresponding recess (not shown) formed in the adjacent end surface of the front auxiliary bed 4*a* or in an appropriate lug (also not shown) provided thereon to serve as a well-known form of yieldable detent means. As will readily be understood, when swung up into the solid-line position in FIG. 2, the front auxiliary bed 4*a* is automatically held upright in that position by such ball detent means. Another steel ball, not shown, is similarly arranged on a rearwardly extended bottom portion 11 of the column 2 in its side adjacent to the rear auxiliary bed 4*b* to serve the purpose of holding the latter in the upswung position shown in FIG. 2.

As clearly shown in FIG. 2, each of the box-like auxiliary beds 4*a* and 4*b* has substantially sector-shaped upwardly diverging opposite end walls interconnecting the wide flat portion defining top surface 41*a* or 41*b* and the narrow bottom portion formed with supporting legs 42—42 or 42'—42'. As will readily be appreciated, the top surfaces 41*a* and 41*b* of the auxiliary beds 4*a* and 4*b* when in the the raised position form, in cooperation with the flat top surface of the tubular bed 3, a substantially continuous flat work-supporting table of extended surface area. Substantially the same result can be obtained even if the top surface of the tubular bed 3 be arcuately shaped as indicated by the chain-dotted line 31' in FIG. 2. It will be apparent that during sewing operation the box-like auxiliary beds are closed with the cover plates 40.

the auxiliary beds 4*a* and 4*b* held in their respective upswung positions can each be readily swung down by force overcoming the detaining effect of the associated steel ball 5 and when the auxiliary beds are both fully swung down into contacting engagement with the supporting base 6 of the sewing machine, as indicated by the chain-dotted lines, open spaces are obtained in front of and behind the elongate tubular bed 3, enabling the sewing machine to be used as a free-arm type machine.

The narrow hinged portions of the respective auxiliary beds as held swung down are limited in height to fully expose the tubular bed 3 on its front and rear sides, thus enabling sewing operation on the machine, now of the free-arm type formation, to be performed with particular ease and efficiency. Also, with the downswung auxiliary beds having their open sides covered with flat smooth cover plates 40 and their hinged connections with the base plate 1 effected inside thereof, there exist no exposed sharp edges that may catch the work fabric or injure the operator's hand.

It is contemplated to arrange appropriate partitions and holding means such as clips and hooks in the box-like body of each of the auxiliary beds for efficient use thereof as a storing case for accessories, tools and other articles.

As will readily be recognized, manual operation as required to convert the machine head of the present invention between the two bed settings respectively forming a free-arm type and a flat-table type bed is extraordinarily simple and easy, not necessitating any tool or skill therefor.

What is claimed is:

1. A convertible-bed type sewing machine head comprising: a base plate; a vertical column upstanding from one end portion of said base plate; an elongate tubular bed extending substantially horizontally from a lower portion of said vertical column in overhanging relation to said base plate; a front auxiliary bed including a substantially rectangular hollow box-like body opening on one side thereof and pivotally secured to said base plate along the front edge thereof, by means of a pair of supporting legs formed on said box-like body, for swinging movement to and from an upright position in which the open side of said box-like body faces said tubular bed, said box-like body, as swung into said upright position, having a wide planar top portion formed to define a front auxiliary work-supporting table surface in substantially the same plane as the top surface of said tubular bed, a narrow bottom portion provided with said pair of supporting legs and a pair of substantially sector-shaped opposite end walls diverging upwardly from said bottom portion to said top portion; and a rear auxiliary bed including a substantially rectangular hollow box-like body opening on one side thereof and pivotally secured to said base plate along the rear edge thereof, by means of a pair of supporting legs formed on the second-mentioned box-like body, for swing movement to and from an upright position in which the open side of the box-like body faces said tubular bed, said box-like body of said rear auxiliary bed, as swung into said upright position, having a wide planar top portion formed to define a rear auxiliary work-supporting table surface in substantially the same plane as the top surface of said tubular bed, a narrow bottom portion provided with said pair of supporting legs, and a pair of substantially sector-shaped opposite end walls diverging upwardly from said bottom portion to said top portion: both said front and rear auxiliary beds further including a cover plate fitted to the open side of said box-like body to afford access to the interior thereof, and partitions and holding means, arranged in said box-like body to enable the latter to be used as a case for storing accessories and other articles.

* * * * *